United States Patent [19]

Iwasaki

[11] Patent Number: 4,772,893

[45] Date of Patent: Sep. 20, 1988

[54] SWITCHED STEERABLE MULTIPLE BEAM ANTENNA SYSTEM

[75] Inventor: Richard S. Iwasaki, Palos Verdes Estates, Calif.

[73] Assignee: The United States of America as represented by the Administrator of the National Aeronautics and Space Administration, Washington, D.C.

[21] Appl. No.: 60,196

[22] Filed: Jun. 10, 1987

[51] Int. Cl.[4] ..... H01Q 19/14

[52] U.S. Cl. ..... 343/779; 343/777; 343/778; 342/374; 342/375

[58] Field of Search ..... 343/776, 777, 778, 779, 343/781 R, 785, 783, 756, 786; 342/374, 373, 377, 375

[56] References Cited

U.S. PATENT DOCUMENTS

| | | | |
|---|---|---|---|
| 2,751,586 | 6/1956 | Riblet | 343/776 |
| 3,295,134 | 12/1966 | Lowe | 343/100 |
| 3,295,138 | 12/1966 | Nelson | 342/374 |
| 3,400,405 | 9/1968 | Patterson, Jr. | 343/854 |
| 3,495,262 | 2/1970 | Paine | 343/776 |
| 3,646,559 | 2/1972 | Wiley | 343/100 SA |
| 4,032,922 | 6/1977 | Provencher | 342/373 |
| 4,096,482 | 6/1978 | Walters | 343/778 |
| 4,228,437 | 10/1980 | Shelton | 343/909 |
| 4,443,800 | 4/1984 | Gaglione | 343/372 |
| 4,499,472 | 2/1985 | Willett | 342/374 |

*Primary Examiner*—William L. Sikes
*Assistant Examiner*—Hoanganh Le
*Attorney, Agent, or Firm*—Hardie R. Barr; John R. Manning; Edward K. Fein

[57] ABSTRACT

A steerable multibeam five element cross-feed cluster antenna (16) system. The feed power is divided into five branches. Each branch includes a switching network (12A–12E) comprised of a plurality of time delay elements (90A; 92A) each individually controlled by a respective electromagnetic latching switch (56A,B; 58A,B; 60A,B; 62A,B; 46A,B). Frequency independent individual two-dimensional beam steering at IF scanning frequencies is thereby provided wherein discrete incremental time delays are introduced by the switching networks into each branch and the signals recombined thereafter to form each beam. The electromagnetic latched switching reduces power consumption and permits higher power switching and reciprocal coincident transmit and receive operation. Frequency independence due to incremental time delay switching permits coincident reciprocal operation and steering for transmit-receive signal paths carrying different transmit-receive frequencies. Diagonal quarter wave plates (30B–38B) in the wave guides (30–38) alter polarization from circular to orthogonal linear to provide transmitter-receiver isolation.

5 Claims, 5 Drawing Sheets

SWITCHED STEERABLE MULTIPLE BEAM ANTENNA SYSTEM

ORIGIN OF THE INVENTION

The invention described herein was made in the performance of work under a NASA contract and is subject to Public Law 96-517 (35 U.S.C. §200 et seq.). The contractor has not elected to retain title to the invention.

TECHNICAL FIELD

This invention relates to antenna systems and, more particularly, relates to steerable beam systems.

BACKGROUND OF INVENTION

The need often arises in antenna systems for conveniently altering the directionality of the system. It has long been conventional in the art to provide various types of mechanical steering systems whereby the boresight orientation of the antenna may be altered as in the familiar case of single parabolic dishes mechanically steered by a servomechanism.

Due to obvious disadvantages of these systems, such as their inherent mechanical complexity, other methods were sought for effecting beam steering. One approach involved a conventional phased array technique. In these systems, a plurality of phase shifting elements are arranged in an array, each element of which introduces a predetermined phase shift in the RF signal, thereby effecting steering of the beam as desired.

Although the problems of mechanical beam pointing are thus avoided, other problems are associated with phased array techniques. The requisite RF components are typically complex, expensive, and frequency dependent, thereby rendering reciprocal coincident operation at differing receive and transmit frequencies impossible. Moreover, characteristics of the phase shift elements themselves are problematical. Ferrite phase shifters, for example, are quite lossy with respect to switched time delay lines, prohibitive in physical size for some applications wherein they are arranged in serial fashion, and exhibit undesirable bandwidth and frequency limitations.

In yet another approach, to avoid some of the aforementioned problems, semiconductor control elements are employed for switching in various incremental time delay elements to steer a beam in a frequency independent manner. However, several additional problems are associated with this approach. First, desirable reciprocity in the transmit-receive modes is limited in that high powered transmit signals may either destroy the diodes or self bias them out of their switching mode, thus limiting the usable transmit power level. Moreover, in space communications applications and other applications wherein power consumption is important, switching of such diodes to provide multiple variable time delay increments is undesirable inasmuch as continuous power is required to operate them. Still further, such techniques have been limited to steering of single beams.

Thus, an antenna system was desired for multiple beam steering which was frequency independent relative to other systems, simple in construction, and capable of high power switching while at the same time exhibiting low operational power consumption requirements. Such a system was further desired which permitted reciprocal coincident operation for transmit-receive signal paths wherein the desired beam positioning could be easily specified, and was compatible with binary control signals.

Still further, such a system was sought which provided wide scanning coverage at moderate gain as well as a low gain mode, and favorable receiver-transmitter isolation as well as providing for aforementioned simultaneous coincident use for both forward and return links.

The disadvantages of the prior art hereinbefore noted are overcome by the present invention which will be described with reference to the accompanying drawings.

DISCLOSURE OF THE INVENTION

A steerable multiple beam five element cross feed cluster antenna system. A moderate gain array feeds a semispherical reflector which faces the coverage region. A low gain array, mounted back to back with the moderate gain array to minimize blockage also faces the coverage region.

In a preferred embodiment, each feed array comprises waveguides each having a square cross section and arranged in a cross configuration. More particularly, a central waveguide is provided and first and second pairs of outer waveguides. The first pair define first central longitudinal axes each parallel to and equidistant from and on either side of the main central axis of the central waveguide, respectively. The second pair of outer waveguides, in like manner, define second central longitudinal axes also parallel to, equidistant from, and on either side of the central waveguide main axis, each such axis being spaced a distance from the central axis equal to the spacing of the first axes therefrom.

The central waveguide main axis and first central axes lie in a first plane, and the central waveguide main axis and second central axes lie in a second plane normal to the first plane. In this manner, each plane intersecting and normal to the central waveguide axis and the first and second pairs of central axes defines five points of the aforementioned crosses, each point of a given cross lying on a respective different one of the axes.

A quarter wave plate of dielectric material is disposed within and along each hollow waveguide diagonally whereby each such plate defines a plane and all such planes are parallel.

For each waveguide at the transmitter input end opposing the feed input end a coaxial transmitter input probe is provided extending transversely into and terminating in the waveguide cavity through and normal to one side of the waveguide whereby the longitudinal axis of the probe intersects the quarter wave plate at 45 degrees. In like manner, a receiver output probe is also disposed transversely through and normal to an adjacent side of the waveguide terminating in the same cavity whereby the longitudinal axis thereof is normal to the transmitter probe and 45 degrees with respect to the dielectric plate. In this manner the plate acts as a polarizer, altering circular polarization to orthogonal linear polarization. More particularly, outputs of the plate and thus the transmitter input and receiver output for a given waveguide are two orthogonally oriented linearly polarized signals. The transmit and receive links are thereby inherently isolated.

In an alternate embodiment wherein additional isolation is desired, at each waveguide's transmitter input end an abrupt transition is made to a narrower rectangular waveguide having the aforementioned receiver output probes extending through the wall thereof into its cavity in a direction normal to that of the transmitter probe. The transmit signal is accordingly attenuated due to the cutoff frequency property of waveguides and the frequency separation between the transmit and receive signals.

A plurality of novel IF switching networks are provided, one for each beam and corresponding frequency, which are simultaneously employed in the receive and transmit modes. The function of the particular switching network in the transmit mode is to split the IF power of its corresponding beam into five components, each of which has a preselected discrete time delay as desired introduced by the switching network. Each component is delivered to a respective one of the clustered waveguide transmit input probes after appropriate upconversion by conventional coherent local oscillator mixing techniques and means to the transmit frequency for the particular beam. Thus, for each of five beam frequencies, a component thereof is delivered to each waveguide, each component having a preselected time delay as desired for the particular direction of beam pointing. By altering the relative magnitudes of time delays for each component of a given frequency and corresponding beam, steering of the particular beam is thereby effected. Thus, the waveguides are radiating corresponding variously time shifted components of each of five beams, each beam being at a different transmit frequency and the relative time delay magnitudes of the components of a given beam determining that beam's pointing direction.

The signal received by each waveguide receiver probe is delivered to a corresponding conventional coherent local oscillator mixer means whereby an IF output is developed having a component of each beam frequency. In the receive mode the function of a particular switching network is to appropriately recombine the IF power in the components of its corresponding beam from each waveguide to form each beam and also to re-introduce the same preselected discrete time delays into each component, thereby effecting direction selectivity to the receiving system.

Switching of multiple beams is thereby effected at IF frequencies. Due to incremental discrete time delay elements being introduced by the switching networks, the switching arrangement is frequency independent whereby multiple beams at differing frequencies may be simultaneously reciprocally used in coincidence for both forward and return links. Coincident beams with different frequencies are thereby steered by these differential time delays which make the system frequency independent.

With respect to each switching network, a first terminal and plurality of second terminals is provided, the latter comprised of a single second terminal and first and second pairs of second terminals. With respect to each second terminal pair, a corresponding switching means in the switching network introduces between the first terminal and one of a given pair's terminals any desired combination of a predetermined number of time delays, each provided by an incremental time delay element. An equivalent magnitude of time delay of opposing sign is automatically introduced between the remaining terminal of the given pair and the first terminal. No time delay is introduced between the first and single second terminals which are interconnected directly.

In a preferred embodiment, each switching means for each beam is a pair of rows of four electromechanical double pole double throw latching switches disposed in series whereby symmetry in switching time delay increments is achieved. More particularly, when both arms of a given switch are in a first position, a discrete time delay increment magnitude is added in the first circuit path between one terminal of a terminal pair and the first terminal. A correlative time delay of equal magnitude is subtracted in the second circuit path between the remaining terminal of the pair and the first terminal. With both arms of the switch in the other position, the same time delay increment is subtracted from the first circuit path and added into the second path.

The single second terminal of each switching network is electrically interconnected through the aforementioned receiver - transmitter and local oscillator means to the probes of the central waveguide "C". In like manner, the first and second terminals of the first pair of second terminals of each switching network are connected through their respective receiver - transmitter and local oscillator means to the probes disposed in respective waveguides "A" and "E" positioned in opposition on either side of the central waveguide. Similarly, the first and second terminals of the second pair of second terminals are interconnected through their respective receiver-transmitter and local oscillator means to probes disposed in respective waveguides "B" and "D" positioned on the remaining opposed sides of the central waveguide.

Two dimensional beam position at desired discrete planar locations for each beam is specified by an x,y co-ordinate pair, each coordinate being represented by a binary number. In one embodiment, the x and y positions are each one of sixteen numbers and corresponding positions, each represented by a four bit binary code. Each of 256 beam positions ($16\times16$) in the plane is thereby specifiable by an 8 bit code, four bits each for the x and y co-ordinates, respectively. Moreover, each such beam position may be achieved by introducing a unique combination of time delays into each component of the beam associated with its respective waveguide of the cross feed, this combination being functionally related to the 8 bit number. The first four bits control DPDT switch positions of the switching network associated with the waveguides A–D in one axis while the second four bits control DPDT switch positions of the switching network associated with the waveguides B–E corresponding to the other axis. In this manner the binary nature is employed of the switches which control the magnitude and sign of the particular time delays introduced which are necessary for a particular beam position specified by the binary code for that position.

BRIEF DESCRIPTION OF THE DRAWINGS

The details of the invention will be described in connection with the accompanying drawings, in which.

BEST MODE FOR CARRYING OUT THE INVENTION

Figure 1:
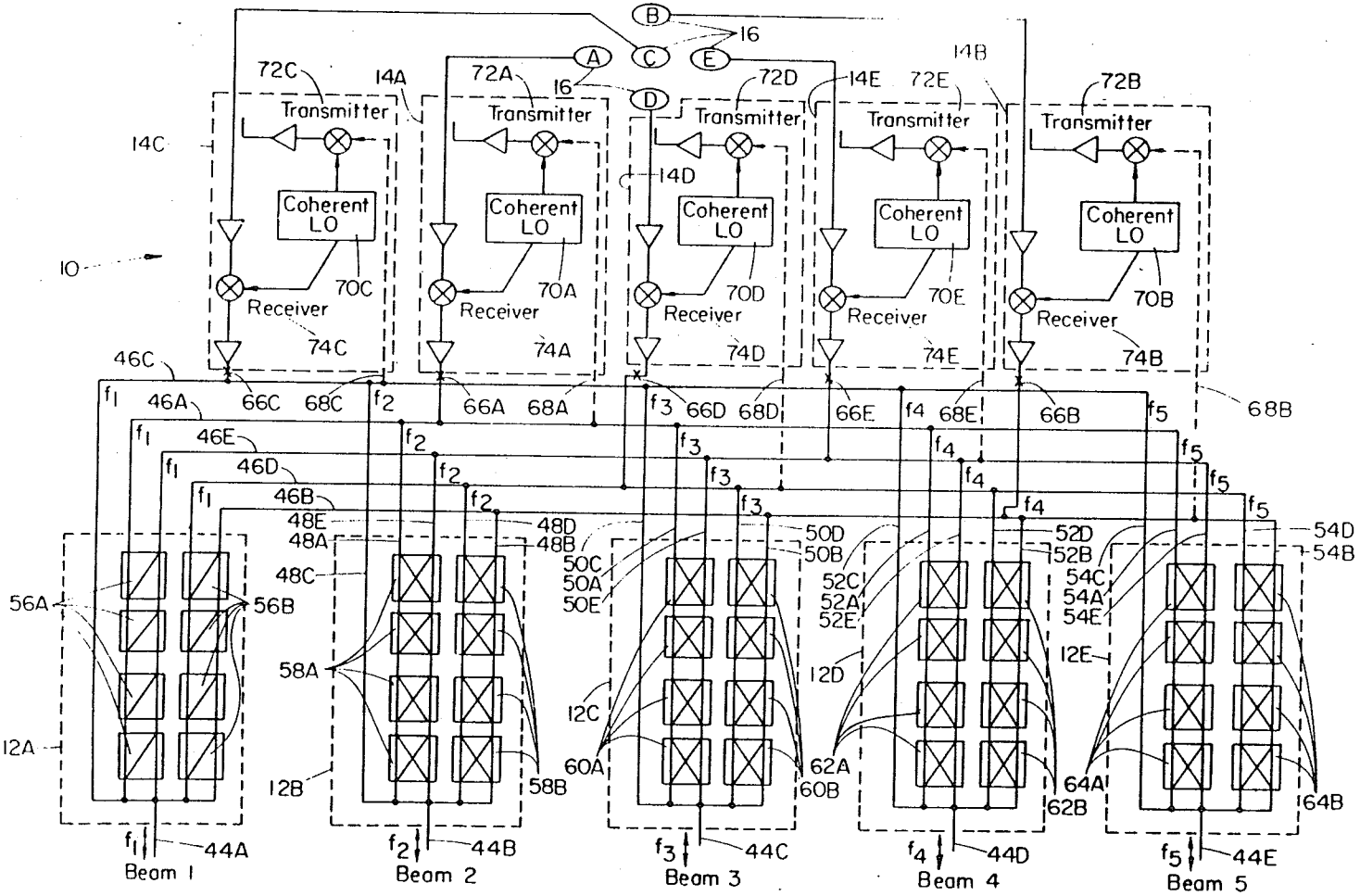
FIG. 1 is a schematic illustration of the switched multiple beam antenna system of the present invention.

Referring first to FIG. 1 there may be depicted therein a schematic illustration of a representative switched multiple beam antenna system 10 of the present invention. Such a system preferrably includes a plurality of switching networks 12A–12E, a correlative plurality of transmitter-receiver means 14A–14E, and multiple element feed arrays such as that of reference numeral 16. The details of the system 10 as depicted in FIG. 1, including detailed discussion of the switching networks, transmitter-receiver means, multiple element feed arrays, and their respective interconnections and functions, will be deferred in order to provide a more general description of a typical application of the system 10 to a communication link such as that depicted with reference to FIGS. 7–8.

Figure 7:
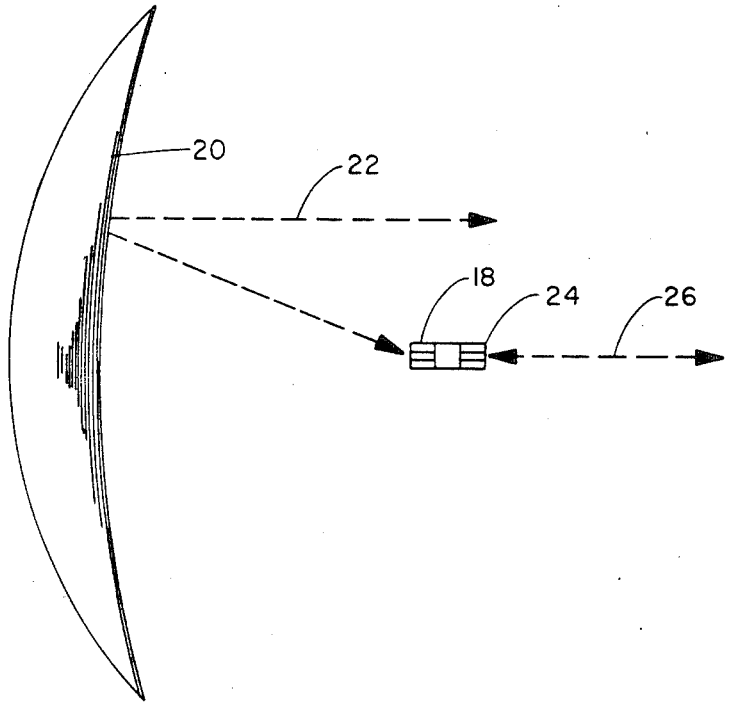
FIG. 7 is a pictorial representation of the semispherical reflector and moderate and low gain feed arrays of the present invention.

Accordingly, referring to FIG. 7, in a typical space communications application a moderate gain feed array 18 is disposed facing a semispherical reflector 20 whereby electromagnetic radiation schematically depicted by arrow 22 may be radiated from the array 18 to the reflector 20, and thence to the desired coverage region. In the alternative, such radiation from the coverage region may be reflected by reflector 20 and thence become incident upon array 18. A low gain feed array 24 is additionally provided facing the coverage region. In this manner EM radiation depicted as arrow 26 may radiate from the feed array 24 to the coverage region and conversely. The feed arrays 18 and 24 are preferrably mounted in a back-to-back configuration and disposed coaxially with respect to reflector 20 so as to minimize blockage. Either of these arrays 18 or 24 may be seen depicted schematically in FIG. 1 as array 16 having elements A–E.

Figure 8:
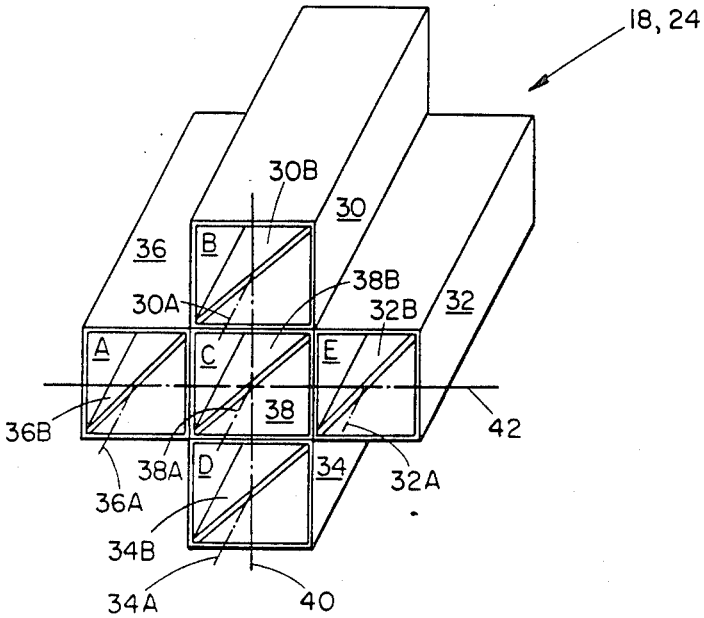
FIG. 8 is a pictorial representation of a five element cross array embodiment of one of the feed arrays depicted in FIG. 7.

FIG. 8 is a pictorial representation of one embodiment of the arrays 18 or 24 wherein for each such array a five element cross array is provided fashioned of a plurality of waveguides. More particularly, a first pair of outer waveguides 30 and 34 also referred to herein as "B" and "D" are provided aligned along respective central outer longitudinal axes 30A and 34A. A second pair of outer waveguides 32 and 36 (hereinafter also referred to as "A" and "E") are provided which are also aligned in like manner along correlative second central longitudinal axes 32A and 36A. A central square waveguide 38 (also referred to as "C") is provided aligned along a main central longitudinal axis 38A. Each such waveguide 30–38 is preferrably a square waveguide, e.g. having a substantially square cross section. The first pair of outer waveguides 30 and 34 may be seen in FIG. 8 as aligned parallel to a first pair of opposing sides of the central waveguide 38. Similarly, the second pair of outer waveguides 32 and 36 are aligned along the second pair of opposing sides of the central waveguide.

Still referring to FIG. 8, the waveguides 30–38 will each contain a correlative quarter wave dielectric polarizing plate such as 30B–38B disposed therewithin and running substantially the length of each respective waveguide. The function of such plates will be hereinafter described in greater detail with reference to FIGS. 2–3. The waveguides 30–38 are correlatively disposed in a manner whereby a first transverse vertical axis 40 intersects the central longitudinal axes 30A, 38A, and 34A while a second transverse horizontal axis 42 intersects the central longitudinal axes 36A, 38A and 32A. In this manner a plurality of planes normal to the main central longitudinal axis 38A defined by the transverse axes 40 and 42 will be intersected by the central longitudinal axes 30A–38A to define five points of a cross, thus giving rise to the terminology used herein in the subject disclosure of a multiple element "cross" array or configuration.

It will be appreciated that although in the preferred embodiment depicted in FIG. 8 a five element cross array is illustrated comprised of five waveguides, the invention is not intended to be so limited and fully admits to alternate cross arrays having a different number of waveguide members. Thus, in an alternate embodiment, in some applications it may be desirable to provide for a nine element cross array, for example. In this configuration, yet an additional first outer pair of waveguides would each be positioned radially outwards of a corresponding different one of the first outer waveguides 30 and 34 parallel thereto. In like manner, each of a next pair of second outer waveguides would be disposed radially outwards of and parallel to a corresponding one of the second outer waveguide pair 32–36, thus forming a nine element cross. Finally, before returning to a more detailed discussion of FIG. 1, it will be noted that the polarizing plates 30B–38B each preferrably define planes parallel to one another and further define a 45 degree angle with respect to intersection with the transverse vertical axis 40.

Returning now to FIG. 1, each of the main components of the system 10 will now be discussed in functional terms in greater detail. First, with respect to the switching networks, in the preferred embodiment of a five element cross array and 5 beam multiple beam embodiment, a corresponding plurality of 5 switching network means 12A–12E is provided. Each network is of a substantially similar construction and function. Thus, while the network 12A will be described in greatest detail, inspection of the reference numerals of FIG. 1 will reveal that correlative reference numerals and description applies with respect to the remaining switching networks 12B–12E.

One function of each switching network means is to divide the power of its respective beam into a plurality of components. Each network is thus provided with a first terminal 44A–44E. Similarly, each network is provided with a plurality of second terminals 46A–E, 48A–E, 50A–E, 52A–E, and 54A–E, each such second terminal carrying a power-divided component of its corresponding beam and frequency introduced at the respective first terminal. Due to the reciprocal feature of the present invention, a second function of the networks 12A–E is to recombine the various beam components residing on the second terminals, and reform them into their respective beams present on the first terminals 44A–E in the receive mode.

With respect to a given network means, it will thus be noted that a plurality of bidirectional signal paths is thereby established, each such path being between a given one of the second terminals and the first terminal. Thus, with respect to network 12C, for example, a first such signal path is established between the second terminal 50C and the first terminal 44C. Also, two pairs of bidirectional signal paths are further established, the first such pair being comprised of the signal path between second terminal 50A and first terminal 44C, and the second signal path of the first pair being defined between second terminal 50E and first terminal 44C. Similarly, a second pair of bidirectional signal paths is defined between second terminal 50D and first terminal 44C and between second terminal 50B and first terminal 44C.

Yet a third function of each switching network means 12A–E is to introduce a discrete incremental time delay of a selectable magnitude and sign into one or more of the thereby established signal paths of the particular switching network means. Inasmuch as each component of a given beam such as components 46A–46E may thereby have introduced by means of its corresponding signal path a preselected time delay, and because these incrementally time-shifted components are thereby employed with respective array elements 16 through corresponding transmitter-receiver means 14A–E, independent beam steering may thereby be achieved in a manner hereinafter described.

With more particular reference now to how the switching network means 12A–E in a preferred embodiment provide such discrete time delays of selectably variable magnitude and sign, each such network includes first and second switching element means such as 56A and 58A, respectively, with respect to illustrative network 12A. Correlative such first and second switching element means for each remaining network 12B–E may be seen in FIG. 1 as indicated by correlative reference numeral pairs 56B,58B; 60A,60B;62A,62B; and 64A,64B. In a preferred embodiment, each such first and second switching means disposed between the first terminal and the first and second pairs of second terminals, respectively, is comprised of four double pole double throw or DPDT switches wired in series and a plurality of discrete time delay element means introduced into the signal paths in functional response to the various positionings of the switches.

More particularly, as will hereinafter be explained in greater detail with respect to an illustrative embodiment described with reference to FIG. 6, using network 12A as an example, each time one of the DPDT switches 56A is positioned in a first position, an increment of time delay is added to one of the signal paths (between terminals 44A–46A or 44A–46E) and a corresponding time delay increment in decreased from the remaining one of the signal paths. When the DPDT switch 56A is positioned in the remaining position, the situation is reversed, i.e. the signal path having the discrete time increment added therein by the corresponding time delay element will now have a correlative time delay subtracted and conversely with respect to the remaining signal path. It will also be noted from the arrangement of the switching element means such as 56A that they are preferrably arranged in series by cumulative discrete time delay increments corresponding to time delay elements associated with each such switch 56A may be cumulatively added in or subtracted out in the particular signal path in functional response to the positioning of the switches 56A.

It is a feature of the instant invention to provide for symmetrical switching for purposes which will also hereinafter become more evident. When a particular switch such as 56A introduces a discrete time delay in one signal path, a correlative time delay of equal magnitude is subtracted out of the corresponding remaining signal path of the signal path pair associated with the particular row of switches such as 56A.

Referring now in greater detail to the function of the transmitter-receiver means 14A–E, in the configuration illustrated in FIG. 1 the system 10 is in a multibeam receiver IF beam scanning network mode. However, it will be noted from the indicated breaks in connections 66A–E and the connections indicated in phantom by reference numerals 68A–68E that when the system 10 is in the multibeam transmitter IF beam scanning network mode, the system may be reconfigured as represented functionally and schematically in FIG. 1 by the breaking of the connections 66A–E and making of connections 68A–E.

In like manner to the switching network means 12A–E, it will be noted first with respect to the transmitter-receiver means 14A–E that a plurality of such means are provided correlative to the number of multiple beams being transmitted and received. Moreover, in like manner to the hereinbefore described switching network means, each such transmitter-receiver means performs substantially the same function and is of substantially identical construction. Accordingly, as may be seen from the correlative reference numerals of FIG. 1, description of one of the transmitter-receiver means will apply equally as well to the remaining transmitter-receiver means.

Each such means may be recognized as a conventional transmitter-receiver well known in the art employing a corresponding local oscillator 70A–E mixed with the transmitter or receiver signals 72A–E or 74A–E, respectively, in a conventional manner. Thus, functionally it will be recognized that one feature of the transmitter-receiver means 14A–E is to receive incoming modulated RF signals detected by the particular transmitter-receiver means' ments 16, to demodulate this input, and provide a demodulated IF output at the locations indicated by the crosses 66A–E for delivery to the corresponding switching network means 12A–E.

Similarly, the function of the transmitter-receiver means 14A–E is also to receive modulated IF signals corresponding to the beams 1–5 passing through their corresponding switching network means 12A–E and present at the inputs 68A–E, and to use these IF signals to modulate a corresponding RF carrier at each respective beam frequency $f_1$–$f_5$, and thence to deliver such modulated RF to the array elements 16 for transmission.

However, an important interconnection of these second terminals 46A–E, 48A–E, 50A–E, 52A–E, 54A–E of the respective switching network means 12A–E with these transmitter-receiver means 14A–E must be noted. As schematically indicated by FIG. 1, by using network means 12A as an example, in the transmit mode 5 outputs on the second terminals thereof corresponding to 5 components of beam 1 at its frequency $f_1$ are provided. Moreover, each component of beam 1 at $f_1$ on second terminals 46A–E has been time delayed by an amount preselected by the settings of the aforementioned DPDT switching means 56A and 56B.

More particularly, the component on terminal 46A may have one discrete time delay of a magnitude and sign functionally related to the positioning of the switches 56A, whereas the component resident on terminal 46E will have a discrete time delay equal in magnitude but of opposing sign also determined by the positioning of the same switches 56A. A similar result obtains with respect to the outputs on the second pair of second terminals 46B–46D, i.e. a switched-in time delay of a magnitude and sign determined by the positioning of switches 56B will be present on the second terminal output 46B, whereas a desired time shift of equal magnitude and opposite sign will be present on correlative output 46D.

Moreover, from FIG. 1 it will be noted that each such component output 46A–E, 48A–E, 50A–E, 52A–E, and 54A–E will be delivered to a different transmitter-receiver means 14A–E. More particularly, the non-timeshifted outputs 46C–54C will be delivered on connection 68C through transmitter-receiver means 14C to the central waveguide C.

Similarly, outputs 46A–54A will be delivered through connection 68A to transmitter-receiver means 14A and thence to waveguide element A. Outputs 46E–54E will be delivered on correlative connection 68E to transmitter-receiver means 14E and thence to array element E and so forth. In the receive mode, similarly, the received IF signal on the outputs 66A–E of correlative transmitter-receiver means 14A–E will be divided and delivered to one second terminal of each switching network means 12A–E.

It will be recalled from FIG. 1 that a discrete selectable time shift of equal magnitude and opposing sign will be associated with pairs of second terminal outputs corresponding to the switch positioning of the correlative switches. Thus, for example, time delays through the signal path 44A–46A will be equal in magnitude to that of the time delay associated with signal path 44A–46E but of opposite sign, the relative sign and magnitude being of course controlled by the positioning of the switches 56A. It will further be noted from FIG. 1 that this time delay associated with the signal path 44A–46A is electrically interconnected to antenna element A, whereas the time delay provided at the second terminal 46E is electrically connected to the antenna array element E. More importantly, referring back to FIG. 8, it will be noted that these antenna elements A and E are on opposing sides of the central square waveguide C.

Similarly, with respect to another beam such as beam 3 at a frequency $f_3$, a time delay at second terminals 50A and 50E will be provided by corresponding signal paths 44C–50A and 44C–50E, such time delays being of equal magnitude and opposite sign, again such magnitude and sign being functionally related to position of switches 60A. Moreover, in like manner to the just described terminals 46A and 46D of switching network means 12A, these time delays associated with second terminals 50A and 50E of equal magnitude and opposing sign will be in functional electrical communication with opposing waveguide elements A and E.

Thus, from an inspection of FIG. 1 in general it will become apparent that for a given beam and frequency, the signal paths created by the correlative switching network means and associated time delays will be such that no time delay is provided by a signal path interconnected to the central waveguide. However, time delays of equal magnitude and opposite sign (the magnitude and sign of which are controlled by the DPDT switches of a given signal path pair) will always be provided to oppositely disposed waveguide elements. Thus, for a given beam and frequency, components thereof will be delivered to each waveguide element. However the magnitude and sign of time delay associated with a given opposed pair of waveguide elements may thus be separately and independently controllable from those associated with the remaining opposed outer pair of antenna elements. In this manner, beam steering or pointing at IF frequencies is thereby achieved. A desired magnitude and sign of time delay is introduced into the signal path associated with any outer waveguide element, and a time delay of like magnitude and opposite sign introduced into the signal path associated with the opposing outer waveguide element.

Figure 4:
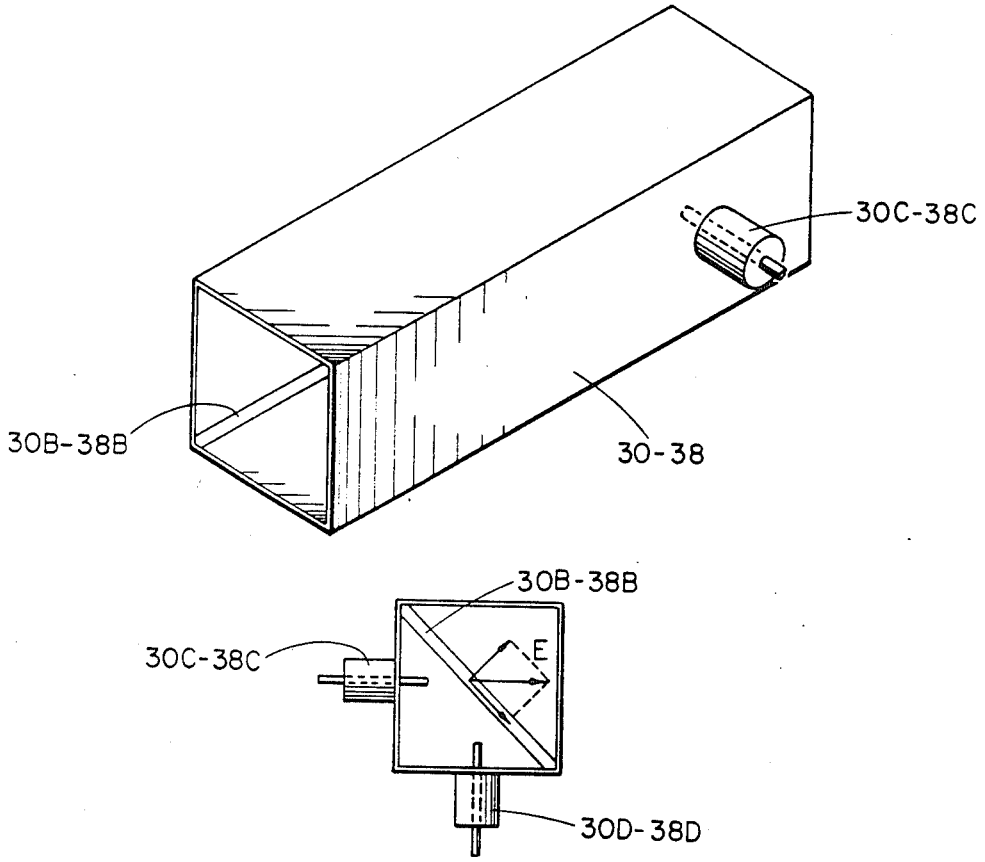
FIG. 4 is a pictorial representation depicting probe configuration for the transmit input of the present invention.

It will be recalled from a discussion of FIG. 8 that for each feed array 16, 18, or 24, a plurality of dielectric quarter wave plate simple polarizers such as the plates 30B–38B are provided, the purpose and operation of which will now be described. Referring to FIG. 4, at the transmitter input end opposite the feed input end of each waveguide element 30–38, a corresponding input probe 30C–38C will preferrably be provided. Each such coaxial transmitter input probe 30C–38C corresponding to its correlative waveguide 30–38 will preferrably be disposed so as to extend transversely into and terminate within the particular respective waveguide cavity through and normal to one side of the waveguide, whereby the longitudinal axis of the probe intersects the quarter wave plate at 45 degrees.

In like manner, as may be also seen in FIG. 4, a receiver output probe 30D–38D is also transversely disposed through and normal to an adjacent side of the waveguide, terminating in the same cavity whereby the longitudinal axis thereof is normal to the transmitter probe axis and 45 degrees with respect to the dielectric plate.

In this manner, the plate acts as a simple polarizer, altering circular polarization to orthogonal linear polarization as may be hereinafter made more clear with reference to the accompanying disclosure of FIGS. 2 and 3, which are pictorial representations of the mechanism of the cross feed of the present invention whereby such circular polarization is altered to the orthogonal linear form. It will be noted in passing that the outputs of each quarter-wave plate and thus the transmitter input and receiver output for a given waveguide, by being two orthogonally oriented linearly polarized signals, accordingly afford inherent isolation to the transmit and receive links, and thus describe the main purpose of the polarizing plates 30B–38B.

Figure 2:
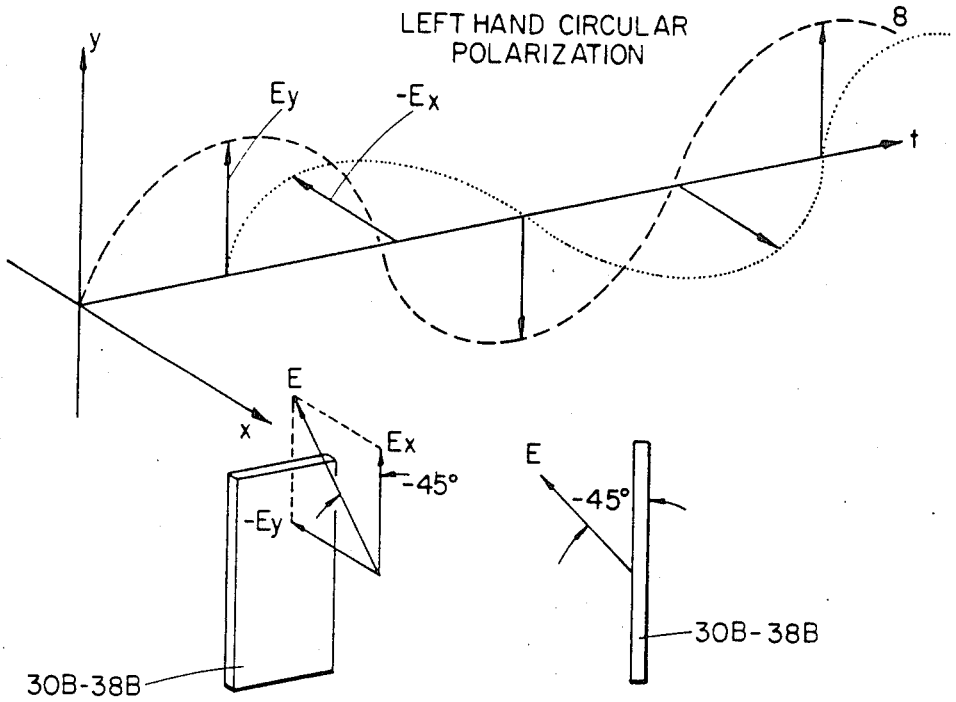
FIG. 2 and FIG. 3 are pictorical representations of the mechanism of the present invention whereby circular polarization in the waveguides thereof is altered to orthogonal linear polarization for isolation.
Figure 3:
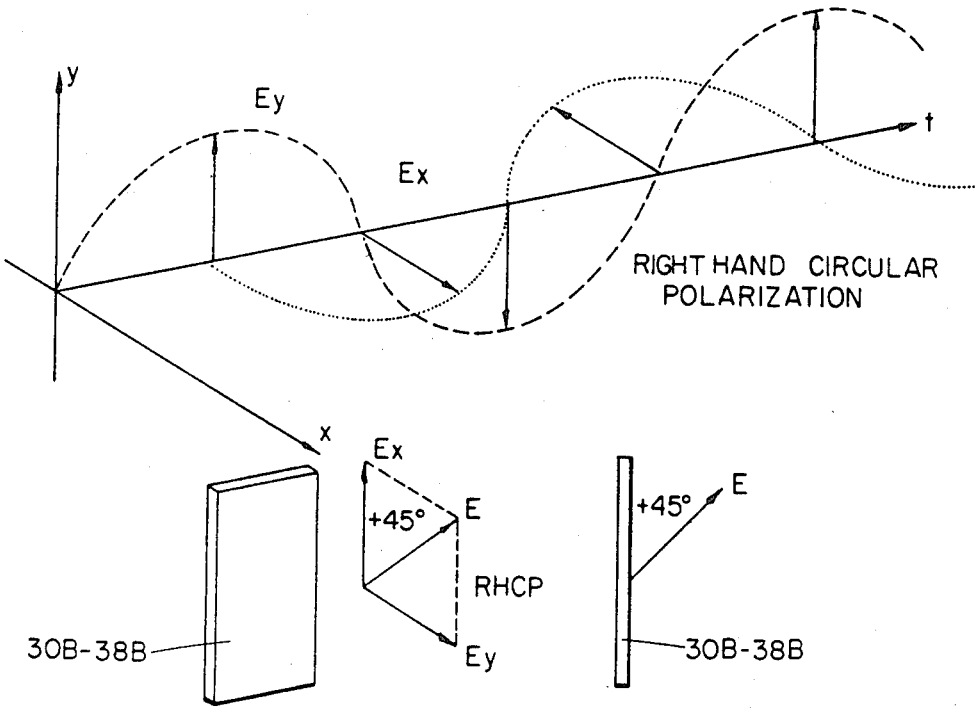

With reference now to FIGS. 2 and 3 in more detail, in order to understand the operation of the dielectric polarizers, a pictorial schematic illustration of the physical delay mechanism which creates the aforesaid orthogonal linear polarization is therein presented. First, the rotating electric field vectors of the lefthand circular polarization and righthand circular polarization waves are shown in FIGS. 2 and 3. It will be appreciated that if the diagonal dielectric quarter wave plate is oriented as depicted in FIGS. 2, 3, and 7, the linearly polarized output signal in the square wave guide is vertical for such lefthand polarization and horizontal for such righthand circular polarization. With reference to the vector diagrams of the electric field vectors depicted in FIGS. 2 and 3, the quarter wave or 90 degree phase delay provided by the quarter wave plate may be seen incorporated into the pictorial representation to illustrate the polarizer mechanism.

It may be noted that the thin dielectric plates 30B–38B delay the component of the electric field vector parallel to the plate but not the component of the electric field vector perpendicular to the plate. When lefthand circular polarization radiation encounters the quarter wave plates, the resultant linearly polarized radiation is −45 degrees relative to the plane of the particular plate. Similarly, righthand circular polarization radiation becomes linearly polarized radiation oriented +45 degrees relative to the plate of the particular dielectric plate. Since the dielectric plate is diagonally located in the square wave-guide, the resultant polarizer plate outputs are two orthogonally oriented linearly polarized signals as hereinbefore note, thereby providing the aforesaid desired inherent isolation between the transmit and receive links.

Figure 5:
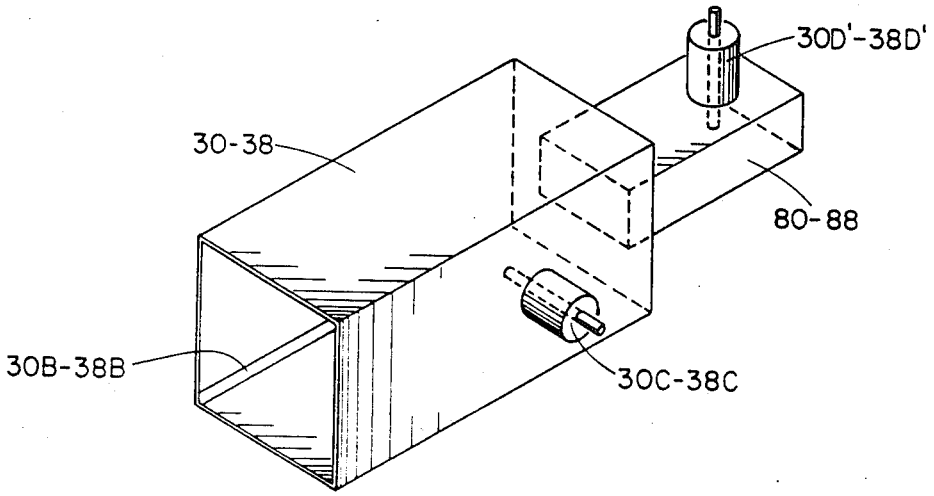
FIG. 5 is a pictorial representation depicting the waveguide cutoff mechanism employed in the present invention to enhance transmitter-receiver isolation.

In an alternate embodiment of the feed arrays 16, 18, and 24 of the present invention wherein additional isolation is desired in the forward and return communication links, at the waveguide transmitter input end of each waveguide of each array, an abrupt transition may be made to a narrower waveguide, such as the waveguides 80–88 of rectangular configuration shown in FIG. 5. Each such rectangular waveguide 80–88 will preferrably have a corresponding coaxial receiver output probe extending through the wall thereof into its cavity in a direction normal to that of the transmitter probe associated with the correlative square waveguide 30–38. The transmit signal is accordingly attenuated in the receiver waveguides 80–88 due to the well known cutoff frequency property of waveguides and the frequency separation between the transmit and receive signals.

It is an important consideration in implementing a multiple switched beam array to provide for simplicity in obtaining a desired beam position. Electromechanical DPDT switches such as those 56A–64A in the switching network means 12A–E depicted in FIG. 1 conveniently have an inherent binary nature whereby any given positioning of such a combination of switches may be uniquely defined by a binary code. For four such switches shown in series in FIG. 1, for example, a beam position in one plane can be characterized by a unique 4 digit binary number corresponding to any one of 16 planar locations ($2^4$).

In like manner, for a two dimensional cross array wherein a beam position must be specified by x plane and y plane beam positions, a total of 256 beam positions (16×16) are possible, with the x and y positions being uniquely specifiable by 4 binary digits each. For example, in order to uniquely define in binary form a position corresponding to the Cartesian x,y coordinates 4,15, in a plane having 16 ordinate and 16 abscissa positions each, the x position of the beam at position 4 may be defined by binary code 0011, whereas the 15 beam position in the ordinate position may be defined by the binary code 1110. Thus, the unique location of the beam position at 4,15 amongst 256 possible beam positions in a 16×16 grid may be defined by the 8 bit binary code 0011 1110, (where the first 4 digits characterize beam position 4 in the x plane, and the last 4 digits characterize beam position 15 in the y plane).

From the foregoing, it will be recognized that such unique binary codes specifying a desired beam position may be utilized in conjunction with the also hereinbefore noted binary nature of the DPDT switches to simply control in binary form the magnitude and sign of incremental time delays or shifts which may be introduced into respective ones of the signal paths associated with each waveguide in order to effect IF beam steering by means of frequency independent or time delay shifts.

Due to the physical characteristics of the particular antenna system and available time shift components and the like, it may be necessary to map a given beam position into a binary code output to control the switches and thus the sets of time shifting elements wherein this output code may differ from the ordinal beam positions represented by the 4 bit binary sequences. The following Table 1 indicates a representative and illustrative such binary output code for each ordinal beam position. Thus, from the table, the previously described beam position 4,15 may actually be represented by the digital sequence 0 0100

TABLE 1

| Beam Position | INPUT Binary Code $b_0$ | $b_1$ | $b_2$ | $b_3$ | OUTPUT Binary Code $a_0$ | $a_1$ | $a_2$ | $a_3$ |
|---|---|---|---|---|---|---|---|---|
| 1 | 0 | 0 | 0 | 0 | 0 | 0 | 0 | 0 |
| 2 | 0 | 0 | 0 | 1 | 1 | 1 | 0 | 0 |
| 3 | 0 | 0 | 1 | 0 | 0 | 1 | 1 | 0 |
| 4 | 0 | 0 | 1 | 1 | 1 | 0 | 1 | 0 |
| 5 | 0 | 1 | 0 | 0 | 0 | 0 | 1 | 1 |
| 6 | 0 | 1 | 0 | 1 | 1 | 1 | 1 | 1 |
| 7 | 0 | 1 | 1 | 0 | 0 | 1 | 0 | 1 |
| 8 | 0 | 1 | 1 | 1 | 1 | 0 | 0 | 1 |
| 9 | 1 | 0 | 0 | 0 | 0 | 0 | 0 | 1 |
| 10 | 1 | 0 | 0 | 1 | 1 | 1 | 0 | 1 |
| 11 | 1 | 0 | 1 | 0 | 0 | 1 | 1 | 1 |
| 12 | 1 | 0 | 1 | 1 | 1 | 0 | 1 | 1 |
| 13 | 1 | 1 | 0 | 0 | 0 | 0 | 1 | 0 |
| 14 | 1 | 1 | 0 | 1 | 1 | 1 | 1 | 0 |
| 15 | 1 | 1 | 1 | 0 | 0 | 1 | 0 | 0 |
| 16 | 1 | 1 | 1 | 1 | 1 | 0 | 0 | 0 |

Attention is further directed to the following Table 2:

TABLE 2

| Beam | Element A | Element B | Element D | Element E | Binary Code |
|---|---|---|---|---|---|
| 1 | $\phi_0 - 10\phi$ | $\phi_0 - 5\phi$ | $\phi_0 + 5\phi$ | $\phi_0 + 10\phi$ | |
| 2 | $\phi_0 - \frac{26\phi}{3}$ | $\phi_0 - \frac{13\phi}{3}$ | $\phi_0 + \frac{13\phi}{3}$ | $\phi_0 + \frac{26\phi}{3}$ | |
| 3 | $\phi_0 - \frac{22\phi}{3}$ | $\phi_0 - \frac{11\phi}{3}$ | $\phi_0 + \frac{11\phi}{3}$ | $\phi_0 + \frac{22\phi}{3}$ | |
| 4 | $\phi_0 - 6\phi$ | $\phi_0 - 3\phi$ | $\phi_0 + 3\phi$ | $\phi_0 + 6\phi$ | 1010 |
| 5 | $\phi_0 - \frac{14\phi}{3}$ | $\phi_0 - \frac{7\phi}{3}$ | $\phi_0 + \frac{7\phi}{3}$ | $\phi_0 + \frac{14\phi}{3}$ | |
| 6 | $\phi_0 - \frac{10\phi}{3}$ | $\phi_0 - \frac{5\phi}{3}$ | $\phi_0 + \frac{5\phi}{3}$ | $\phi_0 + \frac{10\phi}{3}$ | |
| 7 | $\phi_0 - 2\phi$ | $\phi_0 - \phi$ | $\phi_0 + \phi$ | $\phi_0 + 2\phi$ | |
| 8 | $\phi_0 - \frac{2\phi}{3}$ | $\phi_0 - \frac{\phi}{3}$ | $\phi_0 + \frac{\phi}{3}$ | $\phi_0 + \frac{2\phi}{3}$ | |
| 9 | $\phi_0 + \frac{2\phi}{3}$ | $\phi_0 + \frac{\phi}{3}$ | $\phi_0 - \frac{\phi}{3}$ | $\phi_0 - \frac{2\phi}{3}$ | |
| 10 | $\phi_0 + 2\phi$ | $\phi_0 + \phi$ | $\phi_0 - \phi$ | $\phi_0 - 2\phi$ | |
| 11 | $\phi_0 + \frac{10\phi}{3}$ | $\phi_0 + \frac{5\phi}{3}$ | $\phi_0 - \frac{5\phi}{3}$ | $\phi_0 - \frac{10\phi}{3}$ | |
| 12 | $\phi_0 + \frac{14\phi}{3}$ | $\phi_0 + \frac{7\phi}{3}$ | $\phi_0 - \frac{7\phi}{3}$ | $\phi_0 - \frac{14\phi}{3}$ | |

TABLE 2-continued

| Beam | Element A | Element B | Element D | Element E | Binary Code |
|---|---|---|---|---|---|
| 13 | $\phi_0 + 6\phi$ | $\phi_0 + 3\phi$ | $\phi_0 - 3\phi$ | $\phi_0 - 6\phi$ | |
| 14 | $\phi_0 + \frac{22\phi}{3}$ | $\phi_0 + \frac{11\phi}{3}$ | $\phi_0 - \frac{11\phi}{3}$ | $\phi_0 - \frac{22\phi}{3}$ | |
| 15 | $\phi_0 + \frac{26\phi}{3}$ | $\phi_0 + \frac{13\phi}{3}$ | $\phi_0 - \frac{13\phi}{3}$ | $\phi_0 - \frac{26\phi}{3}$ | |
| 16 | $\phi_0 + 10\phi$ | $\phi_0 + 5\phi$ | $\phi_0 - 5\phi$ | $\phi_0 - 10\phi$ | |

In order to simplify an illustration of application of the aforesaid binary code output to the manipulation of the various DPDT switches in the system 10, it may be assumed that it is desired to provide simply for a beam position 4 in the x plane corresponding to binary code output 1010.

Due to the characteristics of the various available discrete time shifting elements, waveguide properties and the like, the foregoing Table 2 indicates the necessary discrete magnitudes and signs of time shifts necessary to be introduced into the various signals paths associated with each element A–E of a representative cross feed waveguide of the present invention in order to effect the desired beam positioning at position 4. In other words, a signal path must be provided associated with each element A,B,D,E, respectively, having a sign and magnitude indicated by the intersection of the particular element's column and the row of beam 4.

Figure 6:
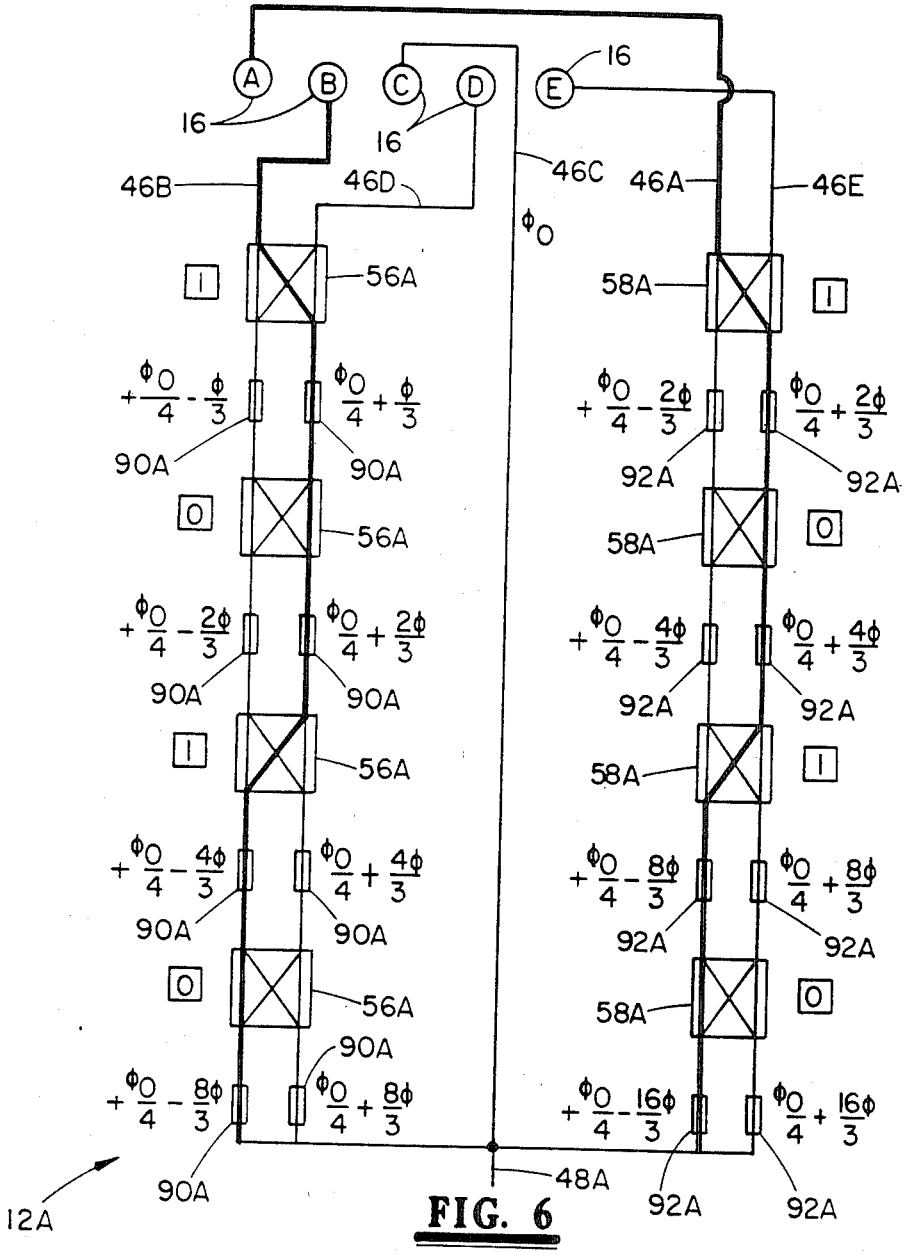
FIG. 6 is a schematic illustration representing time delay switching element settings for one beam position.

Referring now to FIG. 6 there will be seen depicted therein the necessary switching arrangement positioning of switches such as those shown in FIG. 1, and values for discrete time delay elements necessary to achieve this exemplary beam position 4. It will thus be noted that a plurality of discrete time shifting elements 90A and 92A are positioned in series with their respective DPDT switches 56A and 58A. A closer inspection of FIG. 6 will reveal that with respect to each particular individual switch, a pair of discrete time shifting elements of equal magnitude is provided, one of which adds and one of which subtracts the discrete magnitude of shift. Using the notation indicated in FIG. 6 wherein a 0 indicates a straight through switch position and a 1 denotes a cross over switch position and the indicated binary code from the previous table begins with the switch closest to the particular radiating element, the cumulative incremental discrete time delays for each signal path may be determined by summing contributions of each time delay element as follows. With respect to signal paths 46B–48A (associated with waveguide element B), 46D–48A (waveguide element D), 46A–48A (element A), and 46E–48A (element E):

It will thus be seen that the cumulative total magnitudes and signs of the time delays introduced by the switching arrangement shown in the illustration of FIG. 6 correspond to the necessary time shifts for each waveguide element to effect beam positioning at position 4 shown in the Table. Moreover, it will be noted from the example that switching is simplified due to the symmetry in switching time delay increments achieved by using the two arms of the DPDT switches such that one arm adds a specific time delay increment while the other subtracts the same amount.

Further beneficial consequences of the hereindescribed time delay switching also follow. First, the DPDT switches may preferrably be electromechanical latching switches. In this manner, latching operation decreases the operational power consumption requirements by reducing the necessary switching power which may be a single pulse as distinguished from continuous biasing and power consumption in the case of more conventional diode bridges and switches. Moreover, due to the non-directional conductivity of such switches, reciprocal operation for transmit and receive signal paths is thereby provided, also made possible by the fact that due to time delay increment shifting, the beam steering scheme of the present invention is frequency independent, permitting simultaneous coincident transmit and receive modes.

Still further, higher power switching is made possible by using the electromechanical DPDT switches of the present invention and thus avoiding power restriction requirements of more conventional semiconductor switches wherein high power transmit signals may either destroy the diodes or self bias them out of their switching mode, thus limiting the usable transmit power levels. It may be noted, however, that in some applications it may be desirable to substitute electronic switches for the DPDT switches disclosed herein, and, accordingly, the invention is not intended to be so limited to application of such electromechanical switching.

From the foregoing, it will also be readily apparent that a benefit to the binary operation of the switching network means of the present invention due to the two discrete switched states of the DPDT switches allows for simple and straightforward unique binary specification of a specific beam position, which may be readily translated by simple logic circuitry techniques well known in the art. Moreover, because the two axes of the cross of the multiple beam feed arrays of the present invention are orthogonal to each other and can be independently switched, two dimensional beam pointing thereby results.

Now that a detailed description of the invention has been provided, several additional features thereof and aspects of other alternate embodiments will be mentioned. First, it is important to note that whereas the foregoing discussion has for the most part described beam steering at RF (such as S-band at 2 GHz), the invention is not intended to be so limited. Accordingly, such steering or beam switching in accordance with the present invention may, if desired, be accomplished at IF for use with higher RF, such as 40 GHz, wherein this higher RF signal is downconverted to 2 GHz as an IF. Moreover, RF channel dropping bandpass filters may also be employed if it is desirable to effect the switching at RF.

Yet an additional heretofore unmentioned aspect provided by the instant invention may be noted. It is well known that most conventional phased array antenna systems of the prior art are unfortunately of relatively limited bandwidth. However, because the present invention employs switched time delays, the system accordingly is adapted to wide band application.

Still a further aspect of the present invention in need of emphasis relates to the provision for a reflector such as the semispherical reflector for use in conjunction with the cross array. Although it is clear from the schematic illustration and accompanying discussion of FIG. 7 that the invention contemplates operation of the cross array both with and/or without such a reflector this point is in need of further emphasis. Such an array may, of course, feed a reflector to enhance and increase gain and scan limits. However, in applications wherein relatively higher gain is not essential, for example, the array may be used directly for low gain beam steering.

It will further be noted with respect to the waveguide feeds, such as those depicted in FIGS. 4 and 5, that the invention is not intended to be so limited. Thus, for example, virtually any type of radiating element may be employed. In an alternate embodiment, for example, these elements may be comprised of helical radiator antennas.

Also, with respect to the aforementioned waveguide embodiment of these radiating elements, it will be recalled, particularly from FIG. 1 reference element 46C and FIG. 6 reference C that the central radiating element is preferably directly interconnected and not routed through the DPDT switch banks which provide the time delays. A primary benefit of this is that signals corresponding to this central element are accordingly immune to intermittent operation or even complete failure of one or more of the switches (due to vibration or the like), and thus the antenna will nevertheless continue to operate.

Finally, it will be recalled that although electromagnetic DPDT switches have been described as one implementation of these switches, it was hereinbefore noted that the invention was not intended to be limited to such embodiments, and that other forms of switching (such as semiconductor switches) may be beneficially employed. It may now thus be noted with more particularity that in the semiconductor switch form, these switches may be comprised of gallium arsenide field effect transistors.

It is to be noted that the present invention is one well adapted to obtain all of the advantages and features hereinabove set forth, together with other advantages which will become obvious and apparent from a description of the apparatus itself. It will be understood that certain combinations and subcombinations are of utility and may be employed without reference to other features and subcombinations. Moreover, the foregoing disclosure and description of the invention is only illustrative and explanatory thereof, and the invention admits of various changes in the size, shape, and material composition of its components, as well as in the details of the illustrated construction, without departing from the scope and spirit thereof.

What is claimed is:

1. Apparatus for use in a multiple beam antenna system, comprising:

time delay switching network means for providing a plurality of pairs of bi-directional signal paths, each having a discrete time delay of selectably variable magnitude, and wherein each said pair of signal paths comprises a first and second signal path, and wherein said switching network means includes a switching means for adding and subtracting time delays having magnitudes preselected from a plurality of time delays to said first signal path and from said second signal path, respectively.

2. The apparatus of claim 1 wherein said magnitudes are equal.

3. The apparatus of claim 2 wherein said switching means comprises:

a first plurality of switches and discrete incremental time delay elements interconnected in series in said first signal path; and a second plurality of switches and discrete incremental time delay elements interconnected in series in said second signal path.

4. The apparatus of claim 3 wherein said switches are double pole double throw latching switches.

5. The apparatus of claim 4 wherein said switches are electromagnetically actuated.

* * * * *